US006189162B1

(12) United States Patent
Tanner

(10) Patent No.: US 6,189,162 B1
(45) Date of Patent: Feb. 20, 2001

(54) COMBINATION RECEPTACLE AND FLUID IMMOBILIZER

(75) Inventor: James Jay Tanner, Winneconne, WI (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 09/320,955

(22) Filed: May 27, 1999

(51) Int. Cl.[7] ..... A47K 13/14; D21F 11/00

(52) U.S. Cl. ..... 4/450; 4/452; 4/453; 604/317; 604/318; 604/358; 604/359

(58) Field of Search ..... 4/452, 902, 450, 4/453, 300.3, 661, 484; 604/317, 318, 358, 359

(56) References Cited

U.S. PATENT DOCUMENTS

| | | | |
|---|---|---|---|
| 3,512,530 | 5/1970 | Jones, Sr. | 128/290 |
| 3,683,426 | 8/1972 | Lagstrom | 4/484 |
| 3,736,931 | 6/1973 | Glassman | 128/290 R |
| 3,844,288 | 10/1974 | Kiela | 128/287 |
| 4,010,497 | 3/1977 | Menter et al. | 4/300.3 |
| 4,057,061 | 11/1977 | Ishikawa et al. | 128/284 |
| 4,100,324 | 7/1978 | Anderson et al. | 428/288 |
| 4,275,811 | 6/1981 | Miller | 206/204 |
| 4,321,997 | 3/1982 | Miller | 206/204 |
| 4,382,507 | 5/1983 | Miller | 206/204 |
| 4,410,578 | 10/1983 | Miller | 428/117 |
| 4,521,520 | 6/1985 | Jacke | 4/661 |
| 4,537,655 | 8/1985 | Henriksson et al. | 162/23 |
| 4,560,527 | 12/1985 | Harke et al. | 264/500 |
| 4,619,862 | 10/1986 | Sokolowski et al. | 428/221 |
| 4,621,011 | 11/1986 | Fleischer et al. | 428/221 |
| 4,735,846 | 4/1988 | Larsonneur | 428/198 |
| 4,744,113 | 5/1988 | Kogut | 4/661 |
| 4,770,920 | 9/1988 | Larsonneur | 428/198 |
| 4,822,452 | 4/1989 | Tse et al. | 162/146 |
| 4,879,170 | 11/1989 | Radwanski et al. | 428/233 |
| 4,931,355 | 6/1990 | Radwanski et al. | 428/283 |
| 4,940,621 | 7/1990 | Rhodes et al. | 428/137 |
| 4,950,262 | 8/1990 | Takagi | 604/385.1 |
| 5,022,945 | 6/1991 | Rhodes et al. | 156/253 |
| 5,055,332 | 10/1991 | Rhodes et al. | 428/74 |
| 5,137,537 | 8/1992 | Herron et al. | 8/120 |
| 5,183,707 | 2/1993 | Herron et al. | 428/364 |
| 5,242,435 | 9/1993 | Murji et al. | 604/374 |
| 5,295,986 | 3/1994 | Zehner et al. | 604/385.1 |
| 5,320,895 | 6/1994 | Larsonneur et al. | 428/137 |
| 5,374,260 | 12/1994 | Lemay et al. | 604/378 |
| 5,387,385 | 2/1995 | Murji et al. | 264/160 |
| 5,399,412 | 3/1995 | Sudall et al. | 428/153 |
| 5,403,299 | 4/1995 | Schneider | 4/661 |
| 5,415,644 | 5/1995 | Enloe | 604/385.2 |
| 5,455,972 | 10/1995 | Williams | 4/452 |
| 5,466,232 | 11/1995 | Cadieux et al. | 604/378 |
| 5,484,896 | 1/1996 | Naieni et al. | 530/504 |
| 5,492,753 | 2/1996 | Levy et al. | 428/219 |
| 5,549,791 | 8/1996 | Herron et al. | 162/157.6 |
| 5,582,606 | 12/1996 | Bruemmer et al. | 604/385.2 |
| 5,620,431 | 4/1997 | LeMahieu et al. | 604/385.2 |
| 5,634,915 | 6/1997 | Osterdahl | 604/379 |
| 5,649,918 | 7/1997 | Schleinz | 604/385.2 |
| 5,672,248 | 9/1997 | Wendt et al. | 162/109 |
| 5,703,225 | 12/1997 | Shet et al. | 536/59 |
| 5,728,085 | 3/1998 | Widlund et al. | 604/378 |
| 5,730,737 | 3/1998 | Widlund et al. | 604/378 |
| 5,779,860 | 7/1998 | Hollenberg et al. | 162/206 |
| 5,814,034 | 9/1998 | Widlund et al. | 604/367 |
| 5,817,085 | 10/1998 | Widlund et al. | 604/379 |
| 5,867,848 | 2/1999 | Ort | 4/902 |
| 5,903,932 | 5/1999 | Whitesel | 4/484 |
| 5,998,032 | 12/1999 | Hansen et al. . | |

FOREIGN PATENT DOCUMENTS

| | | | |
|---|---|---|---|
| 0 293 208 B1 | 7/1991 | (EP) . | |
| 0 804 912 A1 | 11/1997 | (EP) . | |
| 0 804 913 A1 | 11/1997 | (EP) . | |
| 0 804 916 A1 | 11/1997 | (EP) . | |
| 0 804 917 A1 | 11/1997 | (EP) . | |
| 2196246 | 4/1988 | (GB) | 4/452 |
| 2224522 | 5/1990 | (GB) | 4/452 |
| WO 96/38232 | 12/1996 | (WO) . | |

OTHER PUBLICATIONS

Derwent World Patent Database abstract of JP 92–08787 A: Description of Daiwa Kagaku Kogyo KK; Sanyo Chem Ind. Ltd., "Antimicrobial Water–Absorbing Resin Composition For Packaging".
"Absorbent Core Technology for Personal Care Products," *Teltech Research Services Montly Update*, Mar. 1999, pp. 1–8.

*Primary Examiner*—Charles R. Eloshway
(74) *Attorney, Agent, or Firm*—Thomas J. Connelly

(57) ABSTRACT

A combination receptacle and fluid immobilizer is disclosed for collecting a fluid. The receptacle has a bottom and sidewalls joined to the bottom to form at least a partially enclosed void area. The receptacle has an opening through which a fluid can be collected and later removed. A flushable, fluid immobilizer is positioned within the receptacle and is absorbent. The fluid immobilizer is formed from a multitude of randomly oriented cellulosic fibers that are elastically stressed and bonded by only hydrogen bonds. The fluid immobilizer is capable of capturing and immobilizing fluid which is collected in the receptacle such that the fluid can be transported to a discharge location without having to worry about spillage.

21 Claims, 3 Drawing Sheets

COMBINATION RECEPTACLE AND FLUID IMMOBILIZER

FIELD OF THE INVENTION

This invention relates to a combination receptacle and fluid immobilizer for collecting a fluid. More specifically, this invention relates to a combination receptacle and fluid immobilizer for collecting excreta, especially urine, discharged from a human body.

BACKGROUND OF THE INVENTION

Today, there are a variety of situations that require a fluid to be collected in a receptacle, transported to a second location and be disposed. For example, a receptacle in the form of a bedpan can be used at home, in hospitals and in nursing homes to collect excreta discharged from a human body. These excreta, which normally include urine, must be transported from the patient to a toilet where they can be flushed into the sewage system. Spillage of such body fluids can occur during transport and this can result in contaminating the patient's bed and/or clothing, the caregiver's clothing and/or exposed body parts, such as hands and arms and the floor of the patient room. There are numerous ways to immobilize or stabilize fluids to preclude splashing and spilling from the container. For fluids that cannot be adulterated with added materials, for example milk, one can use baffles within the container to add stability and control spillage. One can minimize the amount of splashing by spacing the baffles closer together. Freezing is another means of immobilizing a fluid to prevent splashing and spillage. Neither of these are practical considerations for bedpans.

It is known to those skilled in the art that the body fluids customarily collected in a bedpan can be immobilized by using granular absorbents such as clay, sawdust, pelleted paper, etc. These granular absorbents are inconvenient to use and commonly are not allowed in a hospital setting. Because of this, there is a need for a sanitary and convenient fluid immobilizer that can be used in a reusable receptacle. The fluid immobilizer should preferably be flushable and capable of stabilizing the fluid in a receptacle, such as a bedpan. The fluid immobilizer should also preclude spilling.

One skilled in the art knows that multiple layers of paper towels, tissues and wipers can be used to absorb fluids and thus immobilize such fluids in a receptacle. However, these types of immobilizers can cause plugging and fouling of toilets and sewage collection systems because they normally contain wet strength additives that prevent breakup. Unlike clay or sawdust, these products are typically made to remain intact and will not exhibit rapid loss of tensile strength when wet. The fluid immobilizer should readily break-up, be flushable and be compatible with sewage disposal systems so that it can be disposed of in a toilet. In addition, the fluid immobilizer should be capable of being readily rinsed from the receptacle so that the receptacle can be cleaned, dried and be made ready for reuse.

Many times it is necessary to weigh the fluid discharged by a patient to determine that proper bowel movement and urination is occurring and that the patient is not constipated or becoming dehydrated. In such situations, the receptacle is normally weighed before being used and is then weighed after body fluid has been discharged into it. By using a fluid immobilizer having a predetermined weight, one can easily accomplish this task while minimizing the likelihood of spillage during transport of the filled receptacle.

Another application where the combination receptacle and fluid immobilizer could be used is in a hair rinse basin.

Elderly people, handicapped people and patients in hospitals sometimes need assistance in washing their hair and therefor require a hair rinse basin. A fluid immobilizer can be inserted into the bottom of the hair rinse basin to prevent splashing and spilling of the wash and rinse water. The fluid immobilizer will assist in keeping the surrounding area, such as the floor, dry and non-slippery. After use, the fluid immobilizer and the wastewater can be easily and quickly disposed of by flushing down a toilet or pouring into a sink or a bathtub.

There are additional applications where a combination receptacle and fluid immobilizer can be used. One such application includes an emesis basin used to collect expectorant, vomit and mouth rinse. Another application is a portable commode bucket used to collect human defecation, urination and menstruation. A third application is a wound irrigation collection basin used to collect excess fluids when irrigating a wound with saline solution or other aqueous liquids. A fourth application is a portable urinal used to collect urine from male bed ridden patients. A fifth application is an ear rinse basin used to collect aqueous fluids utilized to clean or irrigate an ear. All of these applications required disposing of a fluid into a sanitary treatment system which is normally a toilet or a sink. Due to the nature of the fluids and the collection receptacles, there are frequent spills as the fluid is being transported to the nearest toilet or sink. These spills can result in significant contamination requiring immediate clean up. Therefore there is a need for a fluid immobilizer to preclude spilling.

There are also many instances where a patient's health condition can be ascertained from quick, simple measurements of the patient's urine. There is a need for a convenient indicator that can readily provide a caregiver with a signal to determine if there is a change or problem with the patient's health. The fluid immobilizer should possess properties prior to use, which are similar to the properties exhibited by a sheet of paper. For example, the fluid immobilizer should be capable of having alphanumeric symbols printed on it. The fluid immobilizer should also be capable of having various indicators printed thereon to provide a visual indicator. Such indicators can function as urine indicators of pH, glucose, specific gravity, sugar, ketones, bacteria, protein, red blood cells, white blood cells, yeast, parasites, crystals, as well as other substances that need to be known.

In view of the above, it has been recognized that there is a need for a combination reusable receptacle and disposable fluid immobilizer where the fluid immobilizer is easy to insert into the receptacle, inexpensive and flushable. Now a combination receptacle and fluid immobilizer has been invented to satisfy this need.

SUMMARY OF THE INVENTION

Briefly, this invention relates to a combination receptacle and fluid immobilizer for collecting a fluid. The receptacle has a bottom and sidewalls joined to the bottom to form at least a partially enclosed void area. The receptacle has an opening through which a fluid can be collected and later removed. A fluid immobilizer, which is preferably flushable and absorbent, is positioned within the receptacle. The fluid immobilizer is formed from a multitude of randomly oriented cellulosic fibers that are elastically stressed and bonded by hydrogen bonds.

The general object of this invention is to provide a combination receptacle and fluid immobilizer for collecting a fluid. A more specific object of this invention is to provide a combination reusable receptacle and disposable fluid immobilizer for collecting excreta and other body fluids discharged from a human body.

Another object of this invention is to provide a combination receptacle and fluid immobilizer for collecting a fluid wherein the fluid immobilizer containing the collected fluid will readily break apart and can be flushed down a sewage disposal system, such as a toilet or sink.

A further object of this invention is to provide a combination receptacle and fluid immobilizer for collecting a fluid wherein the fluid immobilizer is formed from a multitude of randomly oriented cellulosic fibers that are elastically stressed and bonded by hydrogen bonds.

Still another object of this invention is to provide a fluid immobilizer which has a known capacity and is formed into a rigid sheet that can be easily inserted into a receptacle and be removed therefrom by flushing with water.

Still further, an object of this invention is to provide a combination receptacle and fluid immobilizer for collecting a fluid which is easy to use and inexpensive.

Other objects and advantages of the present invention will become more apparent to those skilled in the art in view of the following description and the accompanying drawings.

DETAILED DESCRIPTION OF THE PREFERRED EMBODIMENTS

Figure 1:
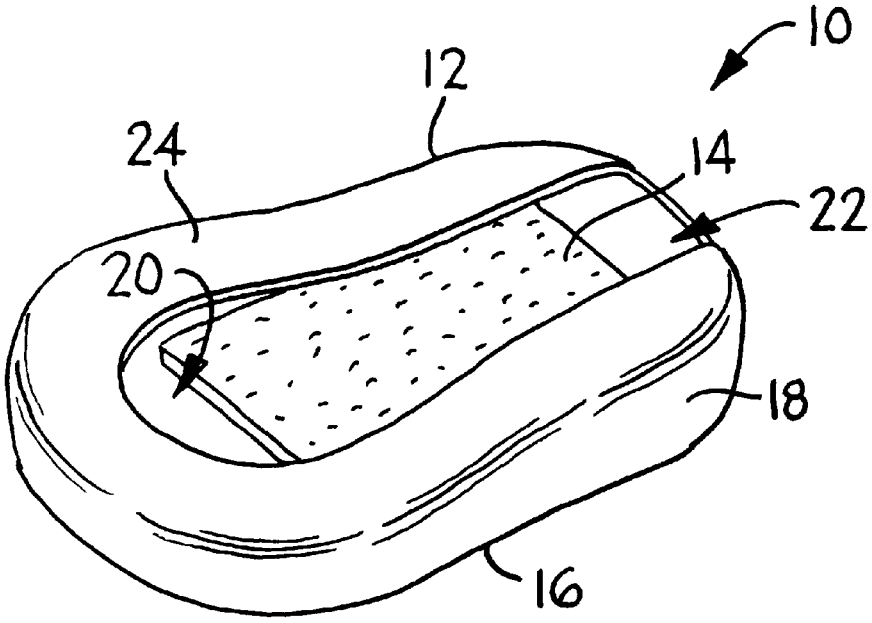
FIG. 1 is a perspective view of a combination receptacle in the form of a bed pan with a fluid immobilizer positioned therein for collecting fluids and excreta discharged from a human body.

Referring to FIG. 1, a combination 10 is shown which includes a receptacle 12 and a fluid immobilizer 14. The receptacle 12 is depicted as a reusable bedpan that is designed to collect fluid and excreta. The receptacle 12 could also be other types of basins, including but not limited to: a hair rinse basin, an emesis basin, a portable commode bucket, a wound irrigation collection basin, a portable urinal, an ear rinse basin, a shampoo and hair rinse basin, etc. The receptacle 12 is designed to collect a fluid and/or a solid. The primary fluids include human body fluids discharged by the body as well as fluids used to wash and clean the body and hair associated with the body. The primary solids include body waste, excreta, body muscle and tissue, body organs, etc. Examples of such fluids and solids include but are not limited to at least one of the following: urine, blood, feces, body tissue, vomit, food, water, rinse water, shampoo, lotion, etc.

As depicted in FIG. 1, the receptacle 12 has a bottom 16 and one or more sidewalls 18 that are joined to the bottom 16 to form at least a partially enclosed void area 20. The receptacle 12 has an opening 22 formed therein through which the fluids and/or solids can be collected and later removed. The size and shape of the opening 22 can vary depending upon the size and shape of the overall receptacle 12 and the function for which it is designed.

When the receptacle 12 is in the form of a bedpan, it can also include a top 24 that at least partially encloses the void area 20. The opening 22 is normally formed in the top 24 of a bedpan. A typical bedpan can have a length of from between about 12 inches to about 20 inches (about 305 mm to about 508 mm), a width of from between about 10 inches to about 18 inches (about 254 mm to about 458 mm) and a height of from between about 2 inches to about 4 inches (about 5 cm to about 10 cm). The opening 22 can be formed in the top 24 and can various in size and configuration. The opening 22 in a typical bedpan may have a length of from between about 10 inches to about 18 inches (about 254 mm to about 458 mm) and a width of from between about 6 inches to about 12 inches (about 153 mm to about 305 mm).

The fluid immobilizer 14 is sized, configured and constructed to be inserted into the receptacle 12 and can be positioned adjacent to the bottom 16. The fluid immobilizer 14 is preferably a uniform sheet having a certain stiffness and integrity when dry. The fluid immobilizer 14 could be a rolled product. As shown in FIG. 1, the fluid immobilizer 14 is positioned flush with the bottom 16 of the receptacle 10 and has a flat or planar characteristic. The fluid immobilizer 14 should be a flushable absorbent that is formed from a multitude of randomly oriented cellulosic fibers. Preferably, the fibers are elastically stressed and only bonded together by hydrogen bonds. The hydrogen bonds are easily broken with the first contact with aqueous fluids. As the fluid immobilizer 14 captures additional fluid, it progressively loses its integrity until it consists of loose fibers with no structure or network integrity. This changes the fluid immobilizer 14 into an array of wet fibers that is easily flushable into a sewage system. The flushability feature of the fluid immobilizer 14 is important to its use and adds to its versatility.

The fluid immobilizer 14 should possess a large absorbent capacity and exhibit exceptional expansion properties when wetted by an aqueous fluid, such as water. The fibers which form the fluid immobilizer 14 should have an average length of from between about 1 millimeter (mm) to about 5 mm. The fluid immobilizer 14 is preferably formed from cellulosic softwood fibers that are relatively stiff. The fibers are randomly oriented and elastically stressed or strained in one or more selected directions. The fibers can be airlaid fibers that are then compressed. The fibers can be thermo-mechanical softwood fibers. Preferably, the fibers are chemi-thermo-mechanical softwood fibers, and most preferably, they are bleached, chemi-thermo-mechanical softwood fiber. The bleaching masks the yellow color that occurs because of the high percentage of lignin that is retained within each fiber.

Preferably, the fibers making up the fluid immobilizer 14 should be non-linear in configuration. At least a majority of the fibers should be non-linear in configuration and exhibit a curved, bent, crimped, kinked, arcuate, contorted, curled or some other non-linear shape. By "kinked" it is meant a tight bend or a sharp twist in a tube-like fiber. It should be noted that the entire fiber does not have to be curved, bent, crimped, kinked, etc. but that at least a portion of the fiber should exhibit a non-linear geometrical shape. The more each fiber is contorted or formed into a non-linear shape, the better the absorbent properties of the fluid immobilizer 14. Linear fibers can be used but they should only represent a minority of the overall fibers present. Preferably, less than about 40 percent of the fibers should be linear.

Each fiber should contain at least about 20 percent lignin and the remaining 80 percent should consist of cellulosic materials, which includes cellulose plus hemicellulose and other minor wood components. Lignin is the chief non-carbohydrate constituent of wood and other fibrous plants. Lignin is a polymer that functions as a natural binder and provides support for the cellulosic fibers. The lignin is present both within each fiber and between adjacent fibers. For purposes of this invention, it is important that the required percent of lignin be present within each fiber. The presence of the lignin within each fiber makes the fibers stiffer and more difficult to bend. This is a major difference from traditional unbonded cellulosic absorbent fibers which are typically bleached southern softwood Kraft fibers which contain very little, if any, lignin within the fiber itself. Hence, the traditional fibers are soft and limp. Lignin functions as a thermoplastic reinforcing material that allows the fibers to return to a natural tubular state upon wetting. Cellulose and hemicellulose give the fibers hydrophilic properties and the ability to form hydrogen bonds in the presence of small amounts of water.

The fibers that form the fluid immobilizer 14 should be randomly oriented and densely compacted. The primary axis of each of the fibers can be oriented in the x-direction, in the y-direction or in the z-direction. This three dimensional, random orientation is beneficial in creating a high absorbent capacity and a high wicking rate within the fluid immobilizer 14. To the contrary, most traditional fibers that have been wet-laid into a fibrous sheet (e.g., paper towels) have virtually all of the fibers laid with their long axis in the x-y plane and a significant number of the fibers lie in the machine direction (MD) or x-direction. Essentially none of the wet-laid fibers are oriented in the vertical or z-direction.

The fibers of this invention are stressed into an extremely compacted condition to form an entangled mass which is held together only by a plurality of hydrogen bonds. Some of the fibers are held in compression, some in bending and some in shear. The hydrogen bonds can be both inter-fiber hydrogen bonds and intra-fiber hydrogen bonds. This is an environment wherein almost every fiber is retained in a stressed or non-relaxed condition. The stress forces may be applied in more than one direction. This gives the bonded fiber array integrity that allows it to be made into sheet form having stiffness and integrity characteristics similar to that of a thick sheet of paper.

Each of the individual fibers should have a diameter of less than about 50 microns. Preferably, the diameter should range from between about 10 microns to about 40 microns, and most preferably, the diameter should range from between about 20 microns to about 30 microns. Each fiber should also have a length of less than about 5 millimeters (mm), preferably the length should be from between about 1 mm to about 5 mm, and most preferably, the length should be from between about 1 mm to about 3 mm. As with most natural materials, there is a distribution of properties, so that stated dimensions should not limit this invention.

Each cellulosic fiber used to form the fluid immobilizer 14 should have a moisture content of from between about 1 percent to about 20 percent water by weight of fiber. Preferably, the moisture content of each fiber is from between about 2 percent to about 15 percent water by weight of fiber. Most preferably, the moisture content of each fiber is from between about 5 percent to about 15 percent water by weight of fiber. This level of moisture is required to obtain hydrogen bonding. However, the fluid immobilizer 14 could be heated until dry after bonding where the moisture level within the fluid immobilizer 14 has essentially dropped to zero. The cellulosic fibers in a non-stressed, unbonded condition have a bulk density of at least 0.01 grams per cubic centimeter (g/cc). Preferably, the bulk density of all the non-stressed fibers is from between about 0.02 g/cc to about 0.1 g/cc. Most preferably, the bulk density of all the non-stressed fibers is from between about 0.05 g/cc to about 0.08 g/cc. The low bulk density of the cluster of non-stressed, unbonded fibers allows for a high level a stress to be induced into the fibers just before bonding them together.

The fluid immobilizer 14 is absorbent and when the cellulosic fibers are in an elastically stressed condition, the fluid immobilizer 14 will have a density, sometimes referred to as "bulk density," of from between about 0.2 g/cc to about 1 g/cc. Preferably, the bulk density of the fluid immobilizer 14 is between about 0.2 g/cc to about 0.8 g/cc. Most preferably, the bulk density of the fluid immobilizer 14 is between about 0.5 g/cc to about 0.8 g/cc. This density is still below the density of the cellulose walls of the individual fibers, which is approximately 1.4 g/cc. Therefore, there is still a significant but reduced amount of open space in the stressed and bonded fluid immobilizer 14, about 33 percent versus 98.6 percent for an unstressed and unbonded air laid absorbent structure of fibers.

The fluid immobilizer 14 should have a basis weight of at least about 100 grams per square meter (gsm). Preferably, the fluid immobilizer 14 will have a basis weight of from between about 200 gsm to about 1,200 gsm. Most preferably, the fluid immobilizer 14 will have a basis weight of from between about 200 gsm to about 1,000 gsm.

The fluid immobilizer 14 should also be constructed such that it has the capacity to capture and immobilize an aqueous fluid. The fluid immobilizer 14 should have the capacity to capture and immobilize at least about 5 cc of fluid per gram of fiber. Preferably, the fluid immobilizer 14 should have the capacity to capture and immobilize from between about 10 cc of fluid per gram of fiber to about 20 cc of fluid per gram of fiber. Most preferably, the fluid immobilizer 14 should have the capacity to capture and immobilize about 15 cc of fluid per gram of fiber.

Another characteristic of the fluid immobilizer 14 is that it should have a determinable tare weight. Because the fluid immobilizer 14 can be made into sheet form having a uniform thickness and basis weight, each unit of volume of the fluid immobilizer sheet 14 has a known weight. For example, if a fluid immobilizer sheet 14 weighted 20 grams (g), a fourth of the sheet would weigh 5 grams. In use, the tare weight correction can be easily determined. Assuming that an empty bedpan weighs 1,000 grams and the tare weigh of the fluid immobilizer weighs 20 grams, then one can determine the weigh of the fluid collected. If the filled bedpan weighs 1,420 grams, then the weight of the fluid collected is 400 grams (1,420 grams−1,000 grams−20 grams=400 grams).

The randomly oriented fibers that make up the fluid immobilizer 14 are bonded together only by a multitude of hydrogen bonds 16. A hydrogen bond is a weak chemical bond formed between an electronegative oxygen atom and a hydrogen atom already bonded to another electronegative oxygen atom. The hydrogen bonds cause the fiber surfaces to be attached to adjacent fiber surfaces. Hydrogen bonding will occur within fibers as well. This condition can occur when, for example, a tubular fiber is twisted or bent and the circular open lumen cross-section collapses to a flattened elliptical shape. When two or more different points inside the lumen touch or are forced together under pressure or stress, hydrogen bonding can occur. In the elastically stressed and bonded condition, the fibers exhibit stored bending, compression and shear energy. Hydrogen bonds form as the fiber surfaces are brought into intimate contact under pressure. Water that is in or on the individual fibers contributes to the intimate contact and formation of the bond even though there is still more liquid capacity in and around the fibers (not saturated). As water leaves the contact point between the fibers due to drying or migration to drier areas, surface tension makes two adjacent fibers or two areas or points inside a fiber lumen come closer together allowing hydrogen bonding to occur. The moisture of the fluid immobilizer 14 should be less than about 15 percent water per unit weight of fiber. Preferably, the moisture of the fluid immobilizer 14 should be from between about 5 percent to about 10 percent water per unit weight of fiber to allow enough hydrogen bonds to form so as to lock in the stressed high density condition. Insufficient moisture would inhibit hydrogen bond formation according to the mechanism described, while excessive moisture would disrupt the hydrogen bonds upon release of the stressing forces.

The hydrogen bonds are relatively weak bonds but they are plentiful and sufficiently strong to lock in the stresses created in and between the fibers as the fibers are stressed into an extremely compacted form of the fluid immobilizer 14. One method of constructing the fluid immobilizer 14 is to collect randomly oriented fibers in a hopper or vessel and then compress the fibers from a single direction into a sheet of fibers. Experimental testing has indicated that when the cellulosic fibers are compressed in only one direction, for example, in the z-direction, then the greatest expansion will occur opposite to this direction of compression.

Experimental testing has also revealed that the fibers can be compressed from two or more directions, either simultaneously or sequentially. When the fluid immobilizer 14 is compressed in two or more directions and later wetted by an aqueous fluid, rapid expansion in directions opposite to the directions of compression will occur. This feature is important for it will allow a manufacturer to construct a fluid immobilizer 14 which can be tailored to the environment in which it is designed to function. For example, it may be desirable to construct a fluid immobilizer 14, which can rapidly expand in the y and z directions. To accomplish this, the fluid immobilizer 14 is compressed during formation in two directions opposite to the y and z directions in which it is to expand. During use, the fluid immobilizer 14 will experience very little expansion in the x-direction but will exhibit substantial and rapid expansion in both the y and z-directions (the y and z-directions together can be a radial direction). The usefulness of being able to construct a fluid immobilizer 14 with such expansion properties will be readily apparent to those skilled in the art of disposable products.

It has been mentioned above that the expansion occurs as an aqueous fluid wets the fluid immobilizer 14. Aqueous fluids are defined for purposes of this invention as fluids that contain water or are similar to water. Representative fluids include tap water, distilled water, bottled water, urine, menses, human body fluids, emulsions of water plus hydrocarbons, etc. It should also be noted that non-aqueous fluids such as oils, non-polar hydrocarbons, etc. would not trigger the release of hydrogen bonds formed in and between the fibers.

As the fluid immobilizer 14 is wetted, the hydrogen bonds break and the stresses locked up in the individual fibers of the fluid immobilizer 14 are released. This causes the fibers to move toward their original relaxed condition, which is a tubular shape, typically in a direction opposite to the direction from which they were stressed or compressed. As more and more hydrogen bonds are broken, more and more fibers are free to flex back to a less stressed or to a relaxed condition. As this occurs, open or void volume develops between the fibers. These voids are capable of receiving and containing the fluid that has insulted the fluid immobilizer 14. The absorbent capacity of the fluid immobilizer 14 is therefore increased and the fluid immobilizer 14 becomes capable of receiving and holding greater quantities of fluid. The increased volume of the capillaries between fibers promotes a higher degree of fluid flow and wicking due to reduce friction or fluid drag. Thus, the fluid immobilizer 14 performs differently from any known cellulosic product commercially sold today. Compressed regenerated cellulose sponges perform somewhat similarly but they are much more expensive to produce and are bonded together into a unit that is not flushable or compatible with most sewage systems.

The fluid immobilizer 14 of this invention is unique in that the wet expansion rate is very rapid. The "wet expansion rate" is defined for purposes of this invention as the time it takes for the fluid immobilizer 14 to expand to its maximum, (change in volume/unit time) once it is surrounded by an aqueous fluid, such as water. The "wet expansion rate" for some portion of the full expansion time can be determined by measuring the slope of the curve established by plotting the change in volume of the fluid immobilizer 14 for each moment in time over the duration of the expansion. The "wet expansion rate" is related to the bulk density of the fluid immobilizer 14 and to the depth of penetration that the fluid must travel to reach the midpoint or mid plane of the fluid immobilizer 14. For example, a spherical shape, at a high density, denoted by the Greek letter rho "ρ", will have a slow maximum expansion rate for it has a low surface area to volume ratio (r) calculated by the formula $r = 6/d$, where d is the diameter of the sphere. This can be contrasted to a thin sheet, like a piece of paper, where a high surface area to volume ratio (r) is found which can be calculated by the formula $r = 2/t$, where t is equal to the thickness of the sheet. The expansion rate for the thin sheet will be faster than for the sphere assuming both have equal weights and equal densities. For a sphere and a sheet of paper of equal weight and density, their size relationship can be expressed by the formula $d = 6\ gsm/p$. In this formula, "d" is the diameter of the sphere, "gsm" is the basis weight of the thin sheet in grams per square meter, and "ρ" is the density of both shapes. In many instances, the rate of fluid impinging upon the fluid immobilizer 14 is rather high, e.g., about 100 cc in 15 seconds. The rapid expansion rate of the fluid immobilizer 14 creates void capacity such that the fluid can be quickly received.

The fluid immobilizer 14 should have the capacity to absorb from between about 1 to about 20 grams of aqueous fluid per gram of absorbent material. Preferably, the fluid immobilizer 14 has the capacity to absorb from between about 1 to about 18 grams of aqueous fluid per gram of absorbent material. More preferably, the fluid immobilizer 14 has the capacity to absorb from between about 1 to about 15 grams of aqueous fluid per gram of absorbent material. The fluid immobilizer 14 is also capable of exhibiting rapid expansion. Starting with a fluid immobilizer 14 having a predetermined initial volume, the fluid immobilizer 14 is capable of expanding from between about 1 to about 8 times its initial volume as the fluid immobilizer 14 absorbs an aqueous fluid. Preferably, the fluid immobilizer 14 is capable of expanding from between about 5 to about 8 times its initial volume as the fluid immobilizer 14 absorbs an aqueous fluid.

Figure 2:
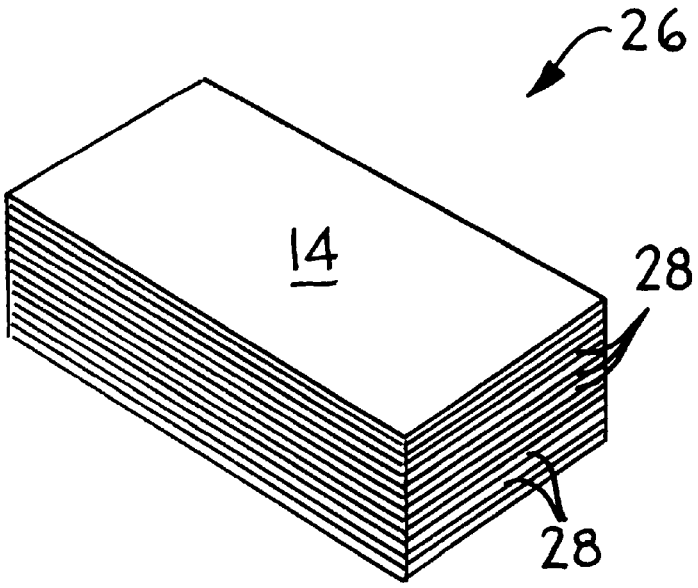
FIG. 2 is a perspective view of a ream of fluid immobilizer sheets that can be individually removed as needed.

Referring now to FIG. 2, a ream 26 of fluid immobilizer sheets 28 is depicted. The multiple sheets 28 are stacked in a similar fashion as a ream of paper sheets. The ream 26 can be enclosed in a paper or plastic envelope for transport and shipping. Once the ream 26 has arrived at its final destination, the packaging can be removed and the ream 26 is ready for use. It is anticipated that a single sheet 28 of the fluid immobilizer 14 will be utilized for each receptacle12. However, there may be situations where it is beneficial to use two or more sheets 28 of the fluid immobilizer 14 in a single receptacle 12. Normally, a caregiver, such as a nurse, will remove a single sheet 28 of the fluid immobilizer 14 from the ream 28 and place it into a receptacle 12. The combination receptacle 12 and fluid immobilizer 14 is than brought to a patient or person needing to use the receptacle 12. The receptacle 12 is then used to collect and store a fluid and/or solid. As the fluid contacts the fluid immobilizer 14, the fluid immobilizer 14 will absorb the fluid and swell in size. As swelling occurs, the hydrogen bonds are broken and the fluid immobilizer 14 expands further. It is desirable to construct the fluid immobilizer 14 such that it can receive up to about 15 cc per gram. This is a condition where the fluid immobilizer sheet 14 is now ready to break apart for disposal into the sewage system. This expansion allows the fluid immobilizer 14 to hold a large amount of fluid within the footprint of the fluid immobilizer 14 and reduces the integrity of the fluid immobilizer sheet 14 so as to make it more acceptable to being flushed down a toilet.

Figure 3:
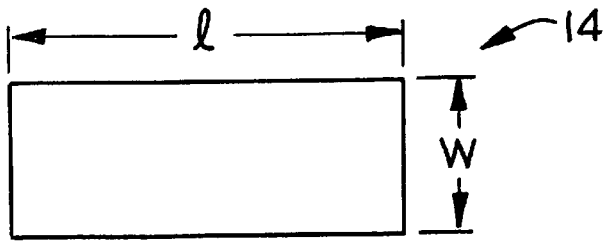
FIG. 3 is a top view of a fluid immobilizer sheet having a rectangular configuration.
Figure 4:
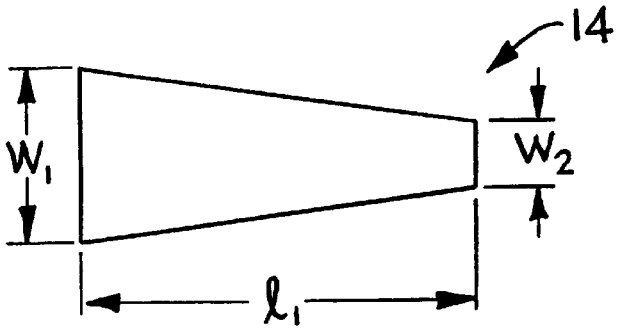
FIG. 4 is a top view of a fluid immobilizer sheet having a trapezoidal configuration.

Referring to FIGS. 3 and 4, two different geometrical configurations are depicted for the fluid immobilizer 14 although other configurations could be utilized if desired. In FIG. 3, a rectangular configuration is depicted having a length "l" and a width "w". The length "l" and the width "w" can be sized to fit a particular receptacle 12. For example, if the receptacle 12 is a bedpan, as depicted in FIG. 1, the length "l" of the fluid immobilizer 14 should be slightly less than the interior length of the bedpan. Likewise the width "w" of the fluid immobilizer 14 should be slightly less than the width of the opening 22 formed in the bedpan so as to enable the fluid immobilizer 14 to be easily inserted therein. It should be noted that it is not necessary for the fluid immobilizer 14 to cover the entire bottom surface of the receptacle 12. In FIG. 1, one can clearly see that the fluid immobilizer 14 just covers the central area of the receptacle 12, that is the area vertically aligned below the opening 22. For best results, the fluid immobilizer 14 should be present at or adjacent to the location where fluids and solids will enter the receptacle 12.

When the fluid immobilizer 14 has a rectangular configuration, as shown in FIG. 3, it can have any desired length, width and thickness. For use in a bedpan or other similar type of basin, the fluid immobilizer 14 should have a length "l" of from between about 2 inches to about 24 inches (about 5.1 centimeters (cm) to about 61 cm). The fluid immobilizer 14 should have a width "w" of from between about 1 inch to about 10 inches (about 2.54 cm to about 25.4 cm) and a thickness of from between about 0.01 inches to about 1 inch (about 0.02 cm to about 2.54 cm). Preferably, the fluid immobilizer 14 is formed as a rectangular sheet having a length "l" of less than about 12 inches (about 30.5 cm), a width "w" of less than about 6 inches (about 15 cm) and a thickness of less than about 0.1 inches (about 0.25 cm). Most preferably, the fluid immobilizer 14 has a length "l" of less than about 10 inches (about 25.4 cm), a width "w" of less than about 4 inches (about 10 cm) and a thickness of less than about 0.04 inches (about 0.1 cm).

Referring again to FIG. 4, the trapezoidal configuration of the fluid immobilizer 14 has a length "l,", a maximum width "$w_1$" and a minimum width "$w_2$". It is anticipated that for best results, the maximum width "$w_1$" should be slightly less in dimension than the width of the opening formed in the receptacle 12. This will ensure that the fluid immobilizer 14 can be easily and quickly inserted into the receptacle 12 and later discharged without difficulty. The exact dimensions of the maximum width "$w_1$" and the minimum width "$w_2$" can vary to suit one's particular needs.

It should be noted that the fluid immobilizer 14 could contain one or more deodorants, one or more fragrances, an air freshener, a dye to change its color, various types of indicators or other substances. The indicator can function as a visual indicator or it can be an invisible chemical that counteracts body fluid odors. Examples of indicators which can be used with the fluid immobilizer 14 include but are not limited to an indicator which can detect urine's useful medical dimensions, pH, glucose, specific gravity, sugar, ketones, bacteria, protein, red blood cells, white blood cells, yeast, parasites, crystals, etc. The fluid immobilizer 14 can contain deodorizing chemicals, such as cyclodextrines or activated carbon that are added to help mitigate the lingering urine odor and fecal odor smells. Fragrance can also be added to provide a more pleasant, fresh and clean smell. The fragrance can also be used to mask certain odors that are deemed offensive. The deodorizers and fragrances can be either dry chemicals or wet chemicals when added to the fluid immobilizer 14 during manufacture. It is also possible to add a deodorizer and/or fragrance to the fluid immobilizer 14 after it has been manufactured.

It should also be noted that the indicator, deodorizer and/or fragrance could be printed onto the fluid immobilizer 14 before use. Since the fluid immobilizer 14 is normally a dry sheet, it easily lends itself to being printed.

Figure 5:
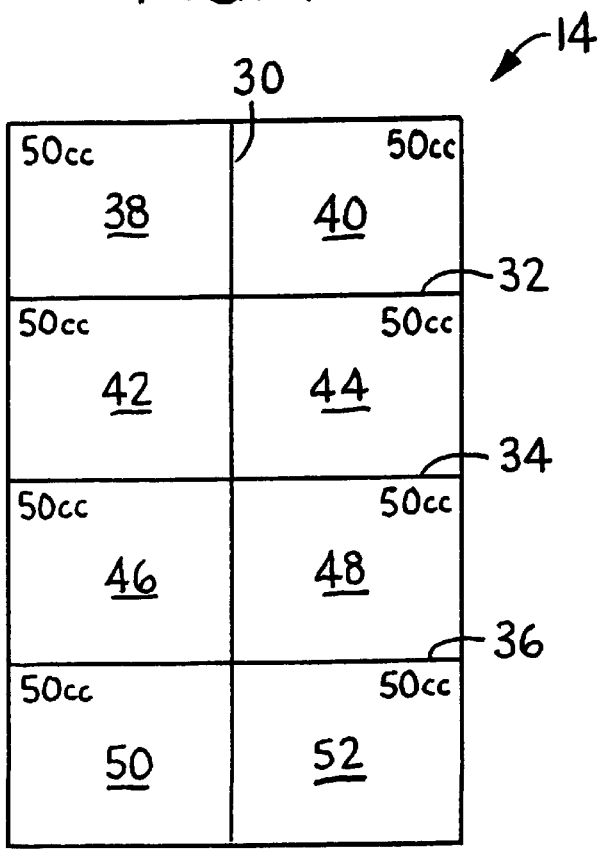
FIG. 5 is a top view of a fluid immobilizer sheet having a plurality of lines and basis weights printed thereon which form a grid pattern such that the sheet can be cut by a pair of scissors to different sizes to fit into different size receptacles.

Referring to FIG. 5, a top view of a fluid immobilizer 14 sheet is shown having printing thereon. The printing can consist of at least one line 30, preferably, at least two lines 30 and 32, and most preferably, a plurality of lines 30, 32, 34 and 36. The lines 30–36 can be drawn to divide the fluid immobilizer sheet 14 into two or more smaller sections 38, 40, 42, 44, 46, 48, 50 and 52. The lines 30–36 can divide the fluid immobilizer sheet 14 into a predetermined grid, scale or pattern that could allow the user to cut appropriate sized sections 38–52 when less than a full sheet 14 is needed. Each of the printed lines 30–36 provides a marking so that a particular section 38–52 can be cut by a pair of scissors or by some other means to fit a particular receptacle 12.

In addition to the lines 30–36, each section 38–52 can contain a printed numerical value or alphanumeric symbol as well. The numerical value can represent: rated capacity of the section, basis weigh of the section, a combination of rated capacity and basis weigh, or any other meaningful value. As shown in FIG. 5, a rated capacity value of 50 cubic centimeters (cc) is printed in a corner of each section 38–52 to indicate to the user the rated capacity of that particular section. The sections 38–52 can be sized to any desired values, for example, 50 cc, 75 cc, 100 cc, etc. By having the rated capacity indicated on each section 38–52, the user can easily use multiple sheets 14 where a greater fluid capacity is required. For example, if a sheet of a fluid immobilizer 14 is only available in 50 cc sections and if a caregiver knows that the quantity of fluid which will be received by a particular receptacle 12 is greater than 50 cc, say about 100 cc, then the caregiver can place two 50 cc sheets 14 into the receptacle 12. This will assure the user that a majority of the fluid dispensed into the receptacle 12 will be absorbed. This in turn will minimize the amount of fluid in the receptacle 12 which is free to be splashed or spilled from the receptacle 12 as it is being transported. By using an appropriate size sheet 14 of a rated capacity, the fluid received by the receptacle 12 can be immobilized until it is ready for disposal in a toilet, sink or another larger receptacle. The fluid immobilizer 14 will not create any clogging or plugging problems in a drain because it does not contain any binder or wet strength agents. This allows the fluid immobilizer 14 to be readily flushed down a toilet or commode.

If desired, the printed numerical value could represent the rated capacity of the fluid immobilizer sheet 14 as well as the weight of the sheet 14. Knowing these two items is advantageous to the caregiver for it allows them to quickly and easily subtract the weight of the fluid immobilizer sheet 14 from the collected fluid, when it is necessary to weigh the fluid contents in the receptacle 12. For example, sometimes it is necessary to measure fluid discharge from a patient to determine that proper bowel movement and urination is occurring. This assures the caregiver that the patient is not constipated or becoming dehydrated. In such situations, the receptacle 12 is normally weighed before being used and is then weighed after fluid has been discharged into it. By using a fluid immobilizer 14 having a predetermined weight, one can easily accomplish this task while minimizing the likelihood of spillage during transport of the filled receptacle 12.

Figure 6:
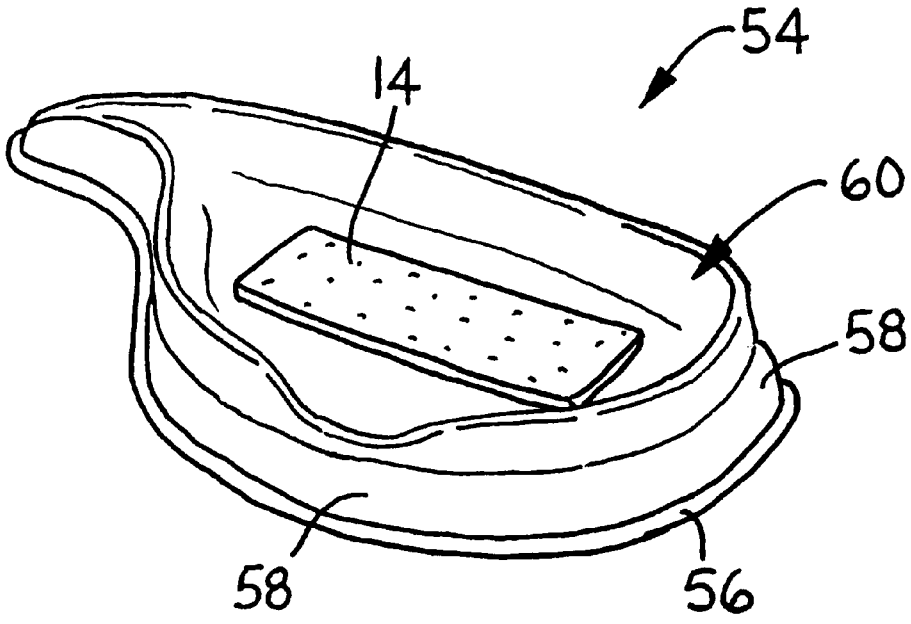
FIG. 6 is a perspective view of a combination receptacle and fluid immobilizer wherein the receptacle is in the form of a hair rinse basin.

Referring now to FIG. 6, a hair rinse basin 54 is shown having a fluid immobilizer sheet 14 positioned therein. The hair rinse basin 54 includes a bottom 56 and sidewalls joined to the bottom 56 to form at least a partially enclosed void area 60. Unlike the bedpan shown in FIG. 1, the hair rinse basin 54 does not have a top. Instead, the entire top of the hair rinse basin 54 is open so as to collect the water, shampoo and particles cleansed from the hair. The fluid immobilizer 14 is again depicted in sheet form and is shown positioned flush with the lower interior surface of the hair rinse basin 54. Since no top is present, it is advantageous to use a fluid immobilizer 14 that can absorb and/or retain a major portion of the fluid that is deposited into the basin 54.

Figure 7:
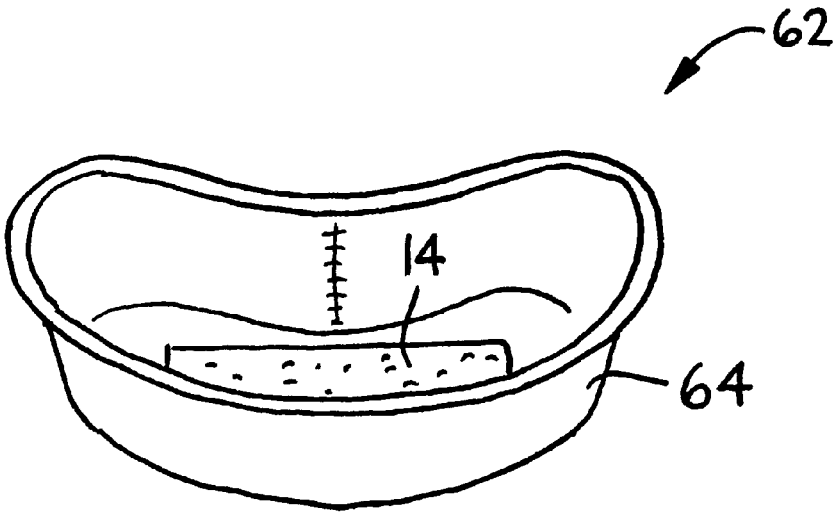
FIG. 7 is a perspective view of a combination receptacle and fluid immobilizer wherein the receptacle is in the form of form of an emesis basin.

Lastly, referring to FIG. 7, an emesis basin 62 is shown having a fluid immobilizer 14 positioned therein. The emesis basin 62 is a relatively small, kidney shaped receptacle that does not have a top. The emesis basin 62 contains sidewalls 64 having a height of about 2 inches (about 5 cm). The emesis basin 62 is commonly used in hospitals in situations where a patient may have to vomit or spit out fluid that is placed in the mouth. Since the emesis basin 62 is a reusable receptacle normally constructed from stainless steel or plastic, there is a tendency for the fluid discharged into it to splash out. For this reason, it is very advantageous to position a fluid immobilizer 14 in the emesis basin 62 prior to its use by the patient.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

I claim:

1. A combination receptacle and fluid immobilizer comprising:

a) a receptacle designed to collect a fluid, said receptacle having a bottom and sidewalls joined to said bottom to form at least a partially enclosed void area, said receptacle having an opening through which said fluid can be collected and later removed; and b) a flushable, fluid immobilizer positioned within said receptacle, said fluid immobilizer being absorbent and capable of rapidly expanding in a direction opposite to a direction of elastic stressing when exposed to said fluid and immobilizing at least some of said fluid which is collected in said receptacle, and said fluid immobilizer being formed from a multitude of randomly oriented cellulosic fibers which are elastically stressed and bonded only by hydrogen bonds, said hydrogen bonds being formed by elastic stressing of said randomly oriented cellulosic fibers.

2. The combination of claim 1 wherein said fluid immobilizer contains at least about 20% lignin, has a moisture content of from between about 1% to about 20% water by weight of fiber, and said fibers of said fluid immobilizer are retained in a stressed condition and have a density of from between about 0.2 g/cc to about 1 g/cc.

3. The combination of claim 1 wherein said fluid immobilizer is made from chemithermo-mechanical softwood fibers.

4. The combination of claim 3 wherein said chemithermo-mechanical softwood fibers are bleached.

5. The combination of claim 1 wherein said fluid immobilizer contains a deodorant.

6. The combination of claim 1 wherein said fluid immobilizer contains an indicator.

7. The combination of claim 6 wherein said indicator is a pH indicator.

8. The combination of claim 6 wherein said indicator is printed on said fluid immobilizer.

9. A combination receptacle and fluid immobilizer comprising:

a) a receptacle designed to collect a fluid, said receptacle having a bottom and sidewalls joined to said bottom to form at least a partially enclosed void area, said receptacle having an opening through which said fluid can be collected and later removed; and b) a flushable, fluid immobilizer positioned within said receptacle, said fluid immobilizer being absorbent and capable of rapidly expanding in a direction opposite to a direction of elastic stressing when exposed to said fluid and immobilizing at least some of said fluid which is collected in said receptacle, said fluid immobilizer being formed from a multitude of randomly oriented cellulosic fibers containing at least about 20% lignin and having a moisture content of from between about 1% to about 20% water by weight of fiber, and said fibers being elastically stressed and bonded only by hydrogen bonds, said hydrogen bonds being formed by elastic stressing of said randomly oriented cellulosic fibers.

10. The combination of claim 9 wherein said fluid immobilizer is made from chemi-thermo-mechanical softwood fibers.

11. The combination of claim 10 wherein said chemithermo-mechanical softwood fibers are bleached.

12. The combination of claim 9 wherein said receptacle is a bedpan.

13. The combination of claim 9 wherein said receptacle is a hair rinse basin.

14. The combination of claim 9 wherein said receptacle is a n emesis basin.

15. A combination receptacle and fluid immobilizer comprising:

a) a receptacle designed to collect a fluid, said receptacle having a top, a bottom and sidewalls connecting said top and said bottom to form at least a partially enclosed void area, said top having an opening forming therein through which said fluid can be collected and later removed; and b) a flushable, fluid immobilizer positioned within said receptacle, said fluid immobilizer being absorbent and capable of rapidly expanding in a direction opposite to a direction of elastic stressing when exposed to said fluid and immobilizing at least some of said fluid which is collected in said receptacle, said fluid immobilizer being formed from a multitude of randomly oriented cellulosic fibers containing at least about 20% lignin and having a moisture content of from between about 1% to about 20% water by weight of fiber, said fibers being elastically stressed and bonded by only hydrogen bonds, said hydrogen bonds being formed by elastic stressing of said randomly oriented cellulosic fibers, and said fibers being retained in a stressed condition and having a density of from between about 0.2 g/cc to about 1 g/cc.

16. The combination of claim 15 wherein said fluid immobilizer has a basis weight of at least about 100 gsm.

17. The combination of claim 16 wherein said fluid immobilizer has a basis weight of from between about 200 gsm to about 1200 gsm.

18. The combination of claim 15 wherein said opening formed in said receptacle has a predetermined width and said fluid immobilizer has a trapezoidal configuration with a maximum width dimension that is less than said width of said opening.

19. The combination of claim 15 wherein said opening formed in said receptacle has a predetermined width and said fluid immobilizer has a rectangular configuration with a maximum width dimension that is less than said width of said opening.

20. The combination of claim 15 wherein said fluid immobilizer contains an indicator.

21. The combination of claim 15 wherein said fluid immobilizer is formed as a sheet containing at least one printed line thereon which indicates where said sheet can be cut should only a partial sheet be required.

* * * * *

UNITED STATES PATENT AND TRADEMARK OFFICE

CERTIFICATE OF CORRECTION

PATENT NO. : 6,189,162 B1
DATED : February 20, 2001
INVENTOR(S) : James J. Tanner It is certified that error appears in the above-identified patent and that said Letters Patent is hereby corrected as shown below:

Column 3,
Line 49, delete "form of".

Column 4,
Line 20, delete "various" and substitute -- vary --.

Column 6,
Line 17, delete the second "a" and substitute -- of --.
Line 59, delete "weigh" and substitute -- weight --.
Line 61, delete "weigh" and substitute -- weight --.

Column 9,
Line 19, delete "I2" and substitute -- 12 --.
Line 25, delete "than" and substitute -- then --.

Column 10,
Line 12, delete "I," and substitute -- $1_1$ --.
Line 64, delete "weigh" and substitute -- weight --.

Column 11,
Line 40, insert -- 58 -- after "sidewalls".

Claim 14,
Line 6, delete "a n" and substitute -- an --.

Signed and Sealed this

Twenty-sixth Day of February, 2002

*Attest:*

*Attesting Officer*

JAMES E. ROGAN
*Director of the United States Patent and Trademark Office*